US008366955B2

(12) United States Patent
Thomas et al.

(10) Patent No.: US 8,366,955 B2
(45) Date of Patent: Feb. 5, 2013

(54) FIRE EXTINGUISHING COMPOSITION

(75) Inventors: Stephanie C. Thomas, Upton, MA (US); Chad Powell, Middleboro, MA (US); Anne C. Regina, Coatesville, PA (US)

(73) Assignee: Kidde-Fenwal, Inc., Ashland, MA (US)

( * ) Notice: Subject to any disclaimer, the term of this patent is extended or adjusted under 35 U.S.C. 154(b) by 0 days.

(21) Appl. No.: 12/995,316

(22) PCT Filed: May 30, 2008

(86) PCT No.: PCT/US2008/065326

§ 371 (c)(1),
(2), (4) Date: Nov. 30, 2010

(87) PCT Pub. No.: WO2009/145783

PCT Pub. Date: Dec. 3, 2009

(65) Prior Publication Data

US 2011/0073795 A1 Mar. 31, 2011

(51) Int. Cl.
*A62D 1/00* (2006.01)
*A62D 1/02* (2006.01)

(52) U.S. Cl. ..... 252/3; 252/2

(58) Field of Classification Search ..... 252/2, 3, 252/4, 5, 6, 6.5, 7, 8, 8.05
See application file for complete search history.

(56) References Cited

U.S. PATENT DOCUMENTS

| | | | | |
|---|---|---|---|---|
| 4,065,394 | A | | 12/1977 | Pratt et al. |
| 4,756,839 | A | * | 7/1988 | Curzon et al. ..... 252/2 |
| 4,999,119 | A | | 3/1991 | Norman et al. |
| 5,085,786 | A | | 2/1992 | Alm et al. |
| 5,207,932 | A | | 5/1993 | Norman et al. |
| 5,651,416 | A | | 7/1997 | Clauson et al. |
| 5,676,876 | A | | 10/1997 | Winkler, III |
| 6,217,788 | B1 | | 4/2001 | Wucherer et al. |
| 6,231,778 | B1 | | 5/2001 | Hansen |
| 6,659,123 | B2 | | 12/2003 | Hyland et al. |
| 6,849,764 | B2 | | 2/2005 | Gurkaynak et al. |
| 2003/0153780 | A1 | | 8/2003 | Haniff et al. |
| 2003/0159836 | A1 | | 8/2003 | Kashiki et al. |
| 2003/0170317 | A1 | | 9/2003 | Curzon et al. |
| 2005/0009937 | A1 | | 1/2005 | Dukles et al. |
| 2006/0228323 | A1 | | 10/2006 | Novelle et al. |

FOREIGN PATENT DOCUMENTS

| | | | |
|---|---|---|---|
| JP | 2004321272 | A | 11/2004 |
| RU | 2188684 | C1 | 9/2002 |
| WO | WO-9911327 | A2 | 3/1999 |
| WO | WO-0041770 | A1 | 7/2000 |

OTHER PUBLICATIONS

Vehicle Fire Protection—An Owner's Manual for Ansul—Fire Suppression/Detections Systems (12 pgs.).
Fire Protection for the Mining Industry, Kidde Fire Systems, www.kiddefiresystems.com (4 pgs.).
Off-Road Vehicle Systems, T&S Fire and Securtiy, Inc., http://www.tsfire.com/offrd.htm, May 9, 2008 (3 pgs.).
International search Report and Written Opinion mailed Aug. 15, 2008 (9 pgs.).

* cited by examiner

*Primary Examiner* — Peter F Godenschwager
(74) *Attorney, Agent, or Firm* — Cantor Colburn LLP

(57) ABSTRACT

A fire extinguishing composition is provided that is suitable for use as a fire extinguishing agent in fire suppression, particularly in off-road vehicles exposed to low ambient temperature environments. The fire extinguishing composition includes an aqueous solution of potassium formate. In an embodiment, the fire extinguishing composition includes an aqueous solution of potassium formate and an aqueous film forming foam. In an embodiment, the fire extinguishing composition is an aqueous solution including an aqueous film forming foam, potassium formate and potassium acetate in water.

15 Claims, No Drawings

FIRE EXTINGUISHING COMPOSITION

FIELD OF THE INVENTION

This invention relates generally to fire extinguishing agents and, in particular, to a wet chemical fire extinguishing composition. More specifically, the invention relates to an aqueous fire fighting foam composition for low temperature applications.

BACKGROUND OF THE INVENTION

Off-road vehicles, such as heavy equipment used in construction, forestry, mining, and other industries, are often used in low ambient temperature environments and in remote locations and may be exposed to multiple types of fire hazards. A vehicle fire that is not effectively suppressed could threaten the safety of the operator and destroy the equipment. Therefore, it is customary practice to crimp off-wad heavy equipment vehicles with on board fire extinguishing and suppression systems. In addition to performing effectively under harsh conditions and low temperatures, any fire fighting agent to be used in a fire extinguishing and suppression system on such vehicles must be able to suppress both class A and class B fires.

Conventional on-board fire suppression systems for use in connection with off-road heavy equipment vehicles exposed to low temperature environments discharge a dry chemical fire extinguishing agent, such as for example monoammonium phosphate, to initially suppress fire. While performing extremely well in knocking down a fire, dry chemical fire extinguishing agents provide minimal protection against possible reflash. Thus, a secondary discharge of wet chemical agent sometimes follows the discharge of the dry chemical agent for cooling hot surfaces in order to prevent relish and for coating surfaces thereby securing those surfaces. Conventional wet chemical agents include an aqueous solution of a single salt or an aqueous foaming solution. Because of the low ambient temperatures to which an off-road vehicle may be exposed, wet chemical agents, whether used for extinguishing the fire per se or used for cooling purposes in combination with a dry chemical fire extinguishing agent in such off-road vehicle fire suppression systems, include a freezing, point depressant, for example, a glycol, such as ethylene or propylene glycol, or a single salt solution, such as an aqueous, solution of potassium acetate or potassium lactate, or a combination of a single salt and either ethylene or propylene glycol.

U.S. Pat. No. 5,651,416 disc loses a meth for extinguishing a fire in an engine compartment or crew compartment using a water based solution including an acetate, chloride, bromide or iodide salt of an alkali metal or ammonium ion, a freezing point, depressant, and a surfactant. Potassium acetate is disclosed as acting as both a tire extinguishing agent and a freezing point depressant. It is stated in U.S. Pat. No. 5,651,416 that at a concentration of 9.0 to 9.5 grams of potassium acetate for every 10 milliliters of water combined with 1 gram of soap, the potassium acetate will be saturated in water at a temperature of −60° F. to −65° F. (−51.1° C. to −53.9° C.).

U.S. Pat. No. 6,231,778 discloses an aqueous foaming fire extinguishing composition suitable for use and storage at a temperature below −1° C. comprising an aqueous solution of 50-60% by weight of 60% aqueous solution of potassium acetate, 7-10% by weight of a 3% solution of aqueous film-forming foam, and 15-20% by weight alkylene glycol selected from the group consisting of ethylene glycol and propylene glycol, and the balance being water.

Whether the salt solution is used as a fire extinguishing agent per se or in combination with dry chemical fire extinguishing agent as a chemical cooling agent, the high salt concentration required to prevent freezing of the aqueous solution in subfreezing ambient temperature environments can reduce the overall environmental acceptability of the fire suppression system. Additionally, the fire fighting effectiveness may be adversely affected since the viscosity of the wet fire extinguishing agent increases as the salt concentration increases and as the temperature decreases. The increased viscosity at low temperatures makes it difficult to obtain a spray at the nozzle. Instead of spraying from the nozzle, these agents at extreme low temperatures may discharge gas a stream which severely limits the coverage area. Another disadvantage lies in the environmental implications of the type of freeze point depressants used. Both propylene and ethylene glycol are toxic substances and must, when used as the sole freeze point depressant, be used in large quantities to obtain the required freezing point. Additionally, an aqueous solution containing a high concentration of glycols may itself be flammable. With pressure to develop more environmentally friendly products, it is desirable to avoid these types of freeze point depressants altogether.

SUMMARY OF THE INVENTION

A composition is provided that is suitable for use as a fire extinguishing agent in fire suppression systems. The composition of the invention is particularly suited for use as a fire extinguishing agent in fire suppression systems on off-road vehicles exposed to low ambient temperature environments.

A tire extinguishing composition is provided comprising an aqueous solution of an aqueous film forming foam (AFFF) and potassium formate. In an embodiment, the fire extinguishing composition comprises an aqueous solution of an aqueous film forming foam, potassium formate and an additional potassium salt.

In an embodiment, the fire extinguishing composition comprises an aqueous solution of an aqueous film forming foam, potassium formate and potassium acetate in water. The potassium formate may be present in an amount between about 1 weight % to 60 weight %. The potassium acetate is present in an amount between about 0 weight % to 59 weight %. The aqueous film forming foam may comprise tetrasodium EDTA and a surfactant, which may include a hydrocarbon surfactant and a fluorosurfactant. The tetrasodium EDTA may be present in an amount between about 0.1 weight % to 3.0 weight %. The fire extinguishing composition may include a foam booster present in an amount up to 1.0 weight %. The fire extinguishing composition may include a biocide present in an amount up to about 0.5 weight %. The fire extinguishing composition may include a corrosion inhibitor, which may be present in a trace amount. The fire extinguishing composition may include acetic acid in an amount sufficient to impart a near neutral pH to the aqueous solution.

In an aspect of the invention, a fire extinguishing aqueous film forming solution consists essentially of an aqueous solution of: potassium formate in an amount of about 20 weight %; potassium acetate in a proportion of about 25 weight % tetrasodium EDTA in an amount of about 2.1 weight %; a hydrocarbon surfactant in an amount of about 0.5 weight %; a fluorosurfactant in an amount of about 0.33 weight %; a foam booster in an amount of about 0.5 weight %; a biocide in an amount of about 0.5 weight %; a corrosion inhibitor in a trace amount; water in an amount of about 51 weight %; and acetic acid in an amount sufficient to impart a near neutral pH to the aqueous solution.

DETAILED. DESCRIPTION OF THE INVENTION

A wet chemical fire extinguishing composition comprises an aqueous solution including potassium formate. In an embodiment, the fire extinguishing composition comprises an aqueous solution including potassium formate and an aqueous film forming foam (AFFF). The potassium formate functions as a freezing point depressant for lowering the freezing point of the aqueous solution to permit storage and use in low temperature environments and as a fire fighting agent. The potassium formate will decompose in a fire to release potassium ions, hydrogen, water and carbon dioxide. The potassium ions will act as free radical scavangers breaking the free radical chain reaction supporting the combustion. The potassium formate may be present in an amount up to about 60 weight % of the aqueous solution. As those skilled in the art will appreciate, the particular amount of potassium formate will depend upon the level of freezing point depression desired and the acceptability of the amount of increase in the viscosity of the aqueous solution resulting from the addition of the potassium formate to the aqueous solution. The maximum freezing point depression attainable with potassium formate as the sole freezing point depressant added to the aqueous solution is achieved at a potassium formate concentration of about 58 weight % of the aqueous solution. Addition of potassium formate in the amount of about 10 weight % of the aqueous solution would depress the freezing point of the aqueous solution to about −23° F. (−5° C.). In an embodiment, potassium formate may be present in an amount from about 10 weight % to 58 weight % of the aqueous solution. In other embodiments, potassium formate may be present in an amount of 10-25 weight %, 25-40 weight %, 40-60 weight % of the aqueous solution.

In an embodiment, the fire extinguishing composition includes an aqueous solution including an aqueous film forming foam, potassium formate and an additional potassium salt. In an embodiment, the additional potassium salt comprises potassium acetate. Each of the potassium formate and the potassium acetate functions as a freezing point depressant for lowering the freezing point of the aqueous solution and as a fire fighting agent. Like potassium formate, potassium acetate will decompose in a fire to release potassium ions, hydrogen, water and carbon dioxide. The potassium ions will act as free radical scavengers breaking the free radical chain reaction supporting the combustion. The use of two salts, that is potassium formate and an additional salt, such as potassium acetate, in the aqueous solution provides a desired freezing point depression at a lower total salt concentration than the concentration of a single salt required to yield the same freezing point depression. Those skilled in the art will appreciate that the particular amount of potassium formate and potassium acetate will depend upon the level of freezing point depression desired and the acceptability of the amount of increase in the viscosity of the aqueous solution resulting from the addition of these potassium salts to the aqueous filming forming solution, in an embodiment of the fire extinguishing composition of the invention, potassium acetate is present in an amount up to about 30 weight %. In other embodiments, potassium acetate is present in an amount of 0-10 weight %, 10-20 weight %, 20-30 weight %.

Potassium formate has the chemical formula: KHCOO and may be represented by the molecular formula:

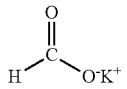

Potassium acetate has the chemical formula: $KCH_3COO$ and may be represented by the molecular formula:

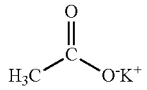

In an embodiment, potassium formate may be present in the fire extinguishing composition in an amount from about 1 weight % to 60 weight % of the aqueous solution. In an embodiment, potassium acetate may be present in the fire extinguishing composition in an amount from about 0 weight % to 59 weight % of the aqueous solution.

The fire extinguishing composition of the invention is particularly suitable for use in fire suppression systems for off-road vehicles operated in low temperature environments. Suitable for use in low temperature environments means that the wet chemical composition not only functions effectively as a fire extinguishing agent, but also may be stored without freezing at temperatures at or below the freezing point of water.

It is to be understood, however, that the fire extinguishing composition of the invention is also suitable for use in fire suppression systems in other vehicles, including, but not limited to, on-road vehicles such as bus and trucks, construction equipment and other industrial equipment, as well as many other fire fighting applications. This aqueous solution fire extinguishing composition has the capability of suppressing the fire, cooling hot surfaces and limiting the potential for reflash.

The aqueous film forming foam component of the aqueous solution fire extinguishing composition may comprise an AFFF concentrate including a hydrocarbon surfactant and a fluorosurfactant. The hydrocarbon surfactant may comprise a non-ionic alkylpolyglycoside, such as for example APG-325N manufactured by the Henkel Corporation, and may be present in an amount of about 0.50 weight % of the aqueous solution. The fluorosurfactant may comprise as perfluoroalkyl compound, such as for example F1157N fluorosurfactant available from E.I. du Pont de Nemours and Company, and may be present in an amount of about 0.33 weight % of the aqueous solution. When the AFFF concentrate is added to water, an aqueous film forming solution is provided.

The aqueous solution fire extinguishing composition may further include a chelating agent, such as for example the tetra sodium salt of ethylene diamine tetraacetic acid (a.k.a. sodium EDTA). The sodium EDTA may be present in an amount between about 0.1 weight %, to 3.0 weight % of the aqueous solution.

The aqueous solution fire extinguishing composition may also include a foam booster, such as for example diethylene glycol monobutyl ether, for example Butyl Carbitol™ foam booster manufactured by The Dow Chemical Company. In an embodiment of the aqueous fire extinguishing composition, the foam booster may be present in an amount between about 0.2 weight % to 1.0 weight % of the aqueous solution.

The aqueous solution fire extinguishing composition may also include a biocide. In an embodiment, the biocide may comprise Kathon CG/ICP manufactured by the Robin and Haas Company of Philadelphia, Pa., USA, which is comprised of 2 active components: 5-Chloro-2-methyl-4 and 2-Methyl-4-isothiazolin-3-one in an inert inorganic salt solution of magnesium chloride and magnesium nitrate. In an embodiment, the biocide may be present in an amount up to about 0.5 weight % of the aqueous solution.

The aqueous solution fire extinguishing composition may also include a trace amount of a corrosion inhibitor or inhibitors, such as for example, Mackam™ 2CY-SF manufactured by the McIntyre Group, LTD, having USA headquarters at University Park, Ill., USA, which is an amphoteric surfactant (disodium capryloamphodipropionate) and Maxhib™ OA-3090, a proprietary formulation available from PCC Chemax, Inc., of Piedmont, S.C., USA. In an embodiment, the aqueous solution fire extinguishing composition may also include trace amounts of a 50% active solution of sodium tolyltriazole as a corrosion inhibitor. Methods for determining the amount of inhibitor sufficient to inhibit corrosion are routine and well known in the art.

The aqueous solution fire extinguishing composition may also include a mild acidifying agent to adjust the pH of the aqueous solution to a near neutral pH value, that is a pH value in the range of about 7.0 to 7.5. Methods for determining the amount sufficient to impart a near neutral pH to the aqueous solution are routine and well known in the art.

In an embodiment, referred to in the following tables as Agent A, the aqueous film forming solution fire extinguishing composition consists essentially of:

potassium formate in an amount of about 20 weight %;

potassium acetate in an amount of about 25 weight %;

tetrasodium EDTA in an amount of about 2.1 weight %;

a hydrocarbon surfactant in an amount of about 0.5 weight %;

a fluorosurfactant in an amount of about 0.33 weight %;

a foam booster in an amount of about 0.5 weight %;

a biocide in an amount of about 0.5 weight %;

a corrosion inhibitor in a trace amount;

water to form the aqueous solution, the water in an amount of about 51 weight %; and acetic acid in a amount sufficient to impart a near neutral pH to the aqueous solution.

The freezing point of this aqueous solution was depressed to below −65° F. (−53.9° C.).

The fire extinguishing agent has undergone comparative testing to illustrate its effectiveness relative to the current offerings of low temperature fire fighting agents for use in off road vehicles. The following is a list of the different agents tested and their properties at 70° F. (21.1° C.) and −20° F. (−28.9° C.), respectively. Agent A is the above-described aqueous film forming embodiment of the tire extinguishing composition of the invention. Agent B is a commercially available fire extinguishing composition from the National Foam division of Kidde Fire Fighting Inc., sold under the tradename Powerex. Agent C is a commercially available fire extinguishing composition from Kidde-Fenwal, Inc., sold under the tradename Arctic Green, Agent D is an aqueous solution of an aqueous film forming foam composition available from the National Foam division of Kidde Fire Fighting Inc. with glycol added thereto as a freeze point depressant in an amount constituting about 50% by volume of the solution. Agent E is an aqueous solution of an aqueous film forming foam composition available from the National Foam division of Kidde Fire Fighting Inc., without glycol added thereto.

Specific gravity is reported in grams per milliliter (g/ml) and viscosity is reported as the kinematic viscosity in centistokes. The surface tension, interfacial tension and spreading coefficient are reported in dynes per square centimeter. The spreading coefficient is the measure of the tendency for spontaneous spreading of an aqueous solution over a non-polar solvent, such as a hydrocarbon fuel and is a dependent upon the surface tension of the hydrocarbon phase, the surface tension of the aqueous phase and the interfacial tension between the hydrocarbon and aqueous phases. If the spreading coefficient is positive, an aqueous solution should spread and provide film formation on a hydrocarbon liquid, such as fuel. The greater the positive value, the greater the spreading tendency. In determining the spreading coefficient for the respective agents, cyclohexane was used as the reference hydrocarbon liquid.

TABLE 1

Various Agent Properties at 70 F. (21.1° C.)

| Agent | Specific Gravity (g/ml) | pH | Viscosity (csks) | Surface Tension (dynes/cm$^2$) | Interfacial Tension (dynes/cm$^2$) | Spreading Coefficient (dynes/cm$^2$) |
|---|---|---|---|---|---|---|
| A | 1.288 | 7.30 | 3.23 | 17.6 | 1.1 | 3.7 |
| B | 1.282 | 7.19 | 5.53 | 17.7 | 1.3 | 3.4 |
| C | 1.277 | 9.86 | 4.52 | 46.7 | 23.0 | −47.3 |
| D | 1.04 | 7.05 | 6.34 | 14.6 | 1.2 | 6.6 |
| E | 1.013 | 7.54 | 1.91 | 18.2 | 2.2 | 2.0 |

TABLE 2

Various Agent Properties at −20 F. (−28.9° C.)

| Agent | Specific Gravity (g/ml) | pH | Viscosity (csks) |
|---|---|---|---|
| A | 1.306 | 7.41 | 5.30 |
| B | 1.307 | 7.20 | 875 cps |
| C | 1.090 | 9.56 | 5.71 |
| D | 1.054 | 7.25 | 10.70 |
| E | Frozen | Frozen | Frozen |

Fire tests have also been completed comparing the new agent to various agents available in the market. The test fire was 19.5"×19.5" pan filled with 1" water and 1" diesel with a splash of heptane. The nozzle was positioned directly over the pan at a height of 37.5" above the base of the pan. The discharge cylinder was filled with 900 ml of agent and pressurized to 250 PSI using Nitrogen. The fire was ignited and after a 2 min pre-burn the agent was discharged.

The following table shows the fire test results.

| Agent | Extinguishment Time | Comments |
|---|---|---|
| A | 5 seconds | Fire extinguished |
| B | 7 seconds | Struggled with corners |
| C | — | Not Extinguished |
| D | — | Not Extinguished |
| E | 7 seconds | Struggled with corners |
| F | 6 seconds | Fire extinguished |

Agent F is a commercially available fire suppression system marketed by Ansul Incorporated of Marinette, Wis., USA, under the tradename Ansul LVS. The aqueous film forming embodiment of the fire extinguishing composition of the invention, Agent A, extinguished the fire more rapidly than the other compositions tested.

An aqueous fire extinguishing composition including potassium formate as the only salt will depress the freeze point of the solution as effectively as an aqueous solution including potassium acetate as the only salt, but at equal salt concentrations the potassium formate aqueous solution will exhibit a lower viscosity than a corresponding potassium acetate aqueous solution. The use of two salts, that is potassium formate and an additional salt, such as potassium acetate, in the aqueous solution provides a desired freezing point depression at a lower total salt concentration than the concentration of a single salt required to yield, the same freezing point depression. Additionally, a potassium formate and potassium acetate aqueous solution will have a lower viscosity at cold temperatures than an aqueous solution of potassium formate and another potassium salt, such as for example, potassium citrate, at the same salt concentration.

The use of a lower salt concentration to impart a desired freezing point depression to an aqueous fire fighting foam solution is advantageous as foaming agents do not perform as well in high salt concentrations because the salt naturally acts as a defoamer. Further, the use of as lower salt concentration to depress the freeze point to the aqueous solution is more environmentally acceptable. The use of a potassium formate, alone or in conjunction with potassium acetate, as a freeze point depressant permits the elimination of glycol from the aqueous solution, thereby rendering the fire extinguishing composition of the invention more environmentally acceptable than commercial fire extinguishing compositions conventionally used in fire suppression systems used in connection with off-road vehicles exposed to ambient temperatures below zero degrees Fahrenheit (−17.8° C.).

The terminology used herein is for the purpose of description, not limitation. Specific compounds and chemical formulations disclosed herein are not to be interpreted as limiting, but merely as basis for teaching one skilled in the art to employ the present invention. While the present invention has been particularly shown and described with reference to the exemplary embodiments discussed, it will be recognized by those skilled in the art that various modifications may be made without departing from the spirit and scope of the invention. Those skilled in the art will also recognize the equivalents that may be substituted for compounds described with reference to the exemplary embodiments disclosed herein without departing from the scope of the present invention.

Therefore, it is intended that the present disclosure not be limited to the particular embodiment(s) disclosed as, but that the disclosure will include all embodiments falling within the scope of the appended claims.

We claim:

1. A fire extinguishing composition comprising an aqueous solution of an aqueous film forming foam, potassium formate and potassium acetate in water, wherein the potassium formate is present in an amount of about 10-60 weight %, and the potassium acetate is present in an amount of about 10-59 weight %.

2. A fire extinguishing composition as recited in claim 1 wherein said aqueous film forming foam comprises a surfactant and tetrasodium EDTA.

3. A fire extinguishing composition as recited in claim 2, wherein the tetrasodium EDTA is present in an amount between about 0.1 weight % to 3.0 weight %.

4. A fire extinguishing composition as recited in claim 2, wherein the surfactant comprises an admixture of a fluorosurfactant and a hydrocarbon surfactant.

5. A fire extinguishing composition as recited in claim 1, further comprising a foam booster present in an amount between about 0.2 weight % to 1.0 weight %.

6. A fire extinguishing composition as recited in claim 1, further comprising a biocide present in an amount up to about 0.5 weight % or a corrosion inhibitor, or both a biocide present in an amount up to about 0.5 weight % and a corrosion inhibitor.

7. A fire extinguishing composition as recited in claim 1, further comprising acetic acid in an amount sufficient to impart a near neutral pH to said aqueous solution.

8. A fire extinguishing composition as recited in claim 1 wherein the potassium formate is present in an amount from about 10 weight % to 58 weight %.

9. A fire extinguishing composition as recited in claim 8, wherein the potassium acetate is present in an amount of about 10-20 weight %.

10. A fire extinguishing composition as recited in claim 8, wherein the potassium acetate is present in an amount of about 20-30 weight %.

11. A fire extinguishing composition as recited in claim 1 wherein the potassium acetate is present in an amount of about 10-30 weight %.

12. A fire extinguishing composition as recited in claim 1, wherein the potassium formate is present in an amount of about 10-60 weight % and wherein the potassium acetate is present in an amount of about 10-20 weight %.

13. A fire extinguishing composition as recited in claim 4, wherein the potassium formate is present in an amount of about 10-60 weight % and wherein the potassium acetate is present in an amount of about 20-30 weight %.

14. A fire extinguishing composition as recited in claim 1 that is free of glycol.

15. An aqueous film forming solution fire extinguishing composition consisting essentially of: potassium formate in an amount of about 20 weight %; potassium acetate in an amount of about 25 weight %; tetrasodium EDTA in an amount of about 2.1 weight %; a hydrocarbon surfactant in an amount of about 0.5 weight %; a fluorosurfactant in an amount of about 0.33 weight %; a foam booster in an amount of about 0.5 weight %; a biocide in an amount of about 0.5 weight %; a corrosion inhibitor in a trace amount; water to form an aqueous solution, the water in an amount of about 51 weight %; and acetic acid in a amount sufficient to impart a relatively neutral pH to the aqueous solution.

* * * * *